US006367171B1

(12) United States Patent
Burt

(10) Patent No.: US 6,367,171 B1
(45) Date of Patent: Apr. 9, 2002

(54) SHOE

(75) Inventor: Igor Burt, Boulder, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/510,156

(22) Filed: Feb. 22, 2000

Related U.S. Application Data

(63) Continuation-in-part of application No. 09/499,304, filed on Feb. 7, 2000.

(51) Int. Cl.[7] ..... A43B 3/24

(52) U.S. Cl. ..... 36/100; 36/68; 36/105; 36/102

(58) Field of Search ..... 36/68, 69, 100, 36/105, 106, 92, 7.2, 7.1 A, 81, 82, 58.6, 138, 102, 88, 51

(56) References Cited

U.S. PATENT DOCUMENTS

| | | | | | |
|---|---|---|---|---|---|
| 4,497 | A | * | 5/1846 | Vetter | 36/51 |
| 117,897 | A | * | 8/1871 | Letson | 36/51 |
| 1,084,197 | A | * | 1/1914 | Collis | 36/89 |
| 1,465,343 | A | * | 8/1923 | Case | 36/51 |
| 1,533,287 | A | * | 4/1925 | Williams | 36/51 |
| 1,586,698 | A | * | 6/1926 | Posner | 36/89 |
| 2,311,996 | A | * | 2/1943 | Parker | 36/51 |
| 2,634,515 | A | * | 4/1953 | Saitta | 36/89 |
| 2,720,042 | A | * | 10/1955 | Marcy | 36/68 |
| 3,192,651 | A | * | 7/1965 | Smith | 36/105 |
| 4,783,909 | A | | 11/1988 | Van Doren | 36/68 |
| 5,054,216 | A | * | 10/1991 | Lin | 36/138 |
| 5,127,170 | A | * | 7/1992 | Messina | 36/105 |

FOREIGN PATENT DOCUMENTS

| | | |
|---|---|---|
| DE | 4243490 | 6/1994 |
| DE | 19611797 | 10/1997 |
| FR | 2761239 | 4/1969 |
| FR | 1562221 | 10/1998 |
| IT | 198948 | 9/1984 |
| IT | 22372/87 | 9/1987 |

* cited by examiner

*Primary Examiner*—Mickey Yu
*Assistant Examiner*—Jila M. Mohandesi
(74) *Attorney, Agent, or Firm*—Greenblum & Bernstein, P.L.C.

(57) ABSTRACT

A shoe adapted to be used as a mule. The shoe has an upper that includes a quarter and a heel piece. These two parts of the shoe are connected by a band that extends to the sole, the band having a greater flexibility than the heel piece and the quarter. This constructive arrangement makes it possible to flatten the heel piece forwardly, and to thus permit entry of the foot into the shoe through the rear.

35 Claims, 5 Drawing Sheets

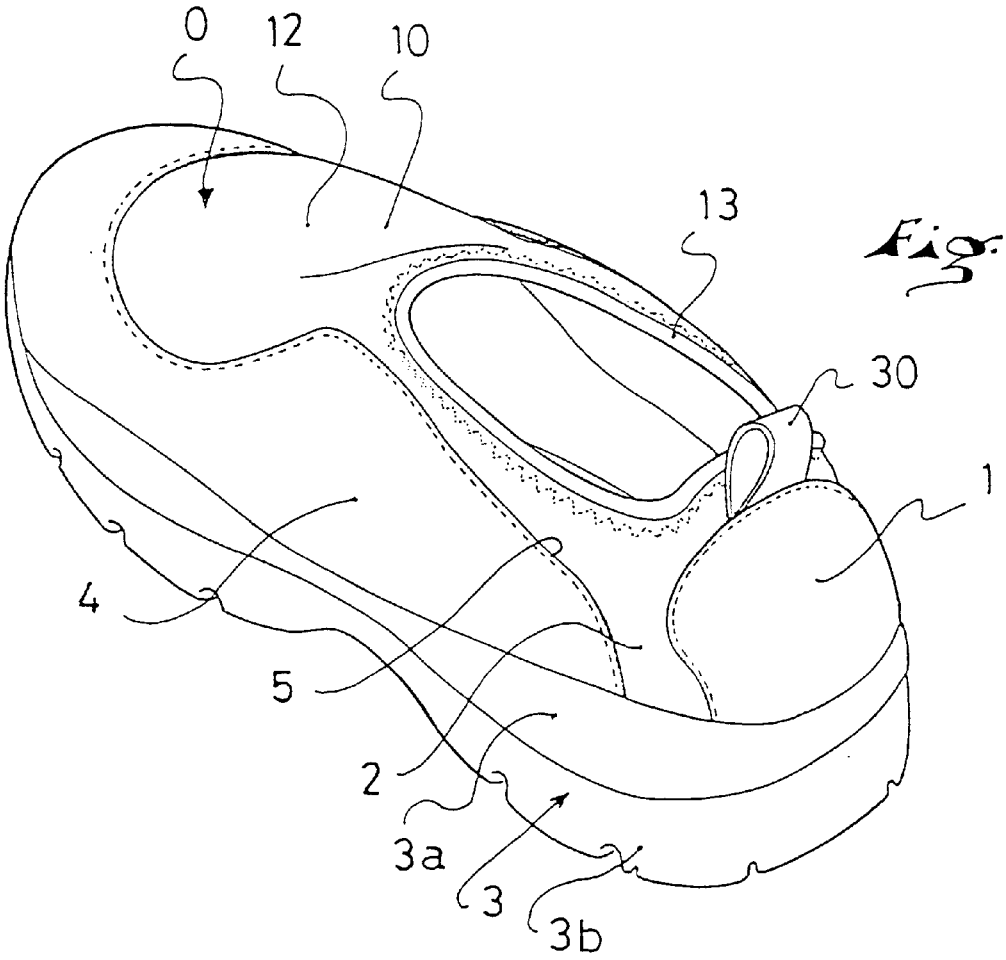
Fig. 1
Fig. 1B
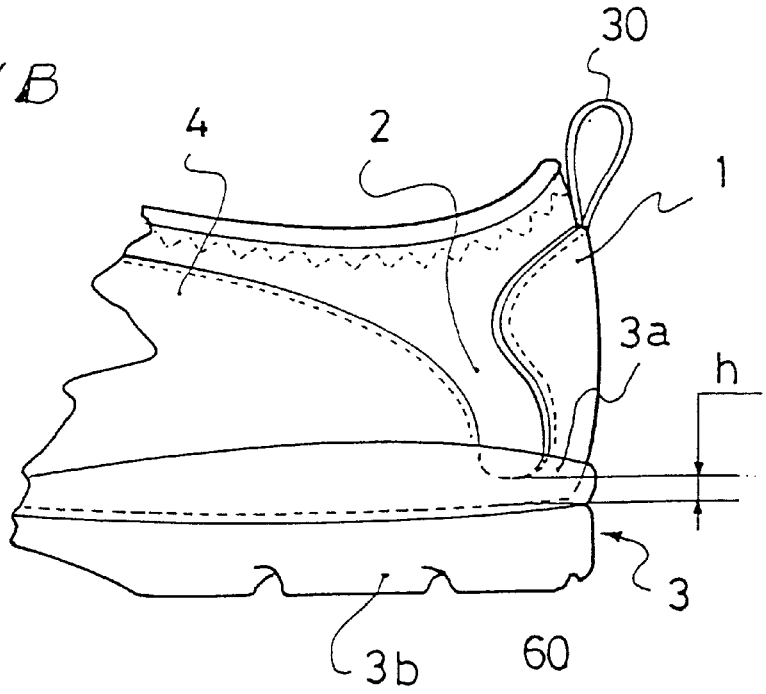

SHOE

CROSS-REFERENCE TO RELATED APPLICATION

This application is a continuation-in-part of application Ser. No. 09/499,304, filed on Feb. 7, 2000, the disclosure of which is incorporated by reference thereto in its entirety and the priority of which is claimed under 35 U.S.C §120.

BACKGROUND OF THE INVENTION

1. Field of the Invention

The present invention relates to a shoe particularly adapted, but not limited, to those intended for the practice of sports. In addition to a conventional retention of the foot by the heel, this shoe can be used as a mule or slipper, e.g., without a structure for retaining the heel. This latter purpose makes it possible to use the shoe as a casual shoe.

2. Description of Background and Relevant Information

In the state of the prior art, there are shoes used in climbing, for example, which have a certain elasticity in the rear lateral portions so as to permit the introduction of the foot therein by moving away, toward the rear, the piece that retains the heel. Some users bend this heel piece forwardly so as to transform the shoe into a mule, in order to relax the foot. However, this improvised use of the climbing shoe remains uncomfortable, because the elastic lateral portions do not extend to the sole and, therefore, the heel piece bends improperly within the shoe.

Other inventions, such as those described in the documents U.S. Pat. No 4,783,909 and IT 22 732/87, include regular shoes which are provided with an appropriate device, in the heel area, to be used as a mule. This device creates a preferred bending zone in the area of the rear lateral portions, by cutting into the shoe upper a slit that extends down to the sole, and by assembling the edges of this slit by means of a zigzag stitch. The slit, in connection with the stitch, acts like a hinge. However, the stitch is extremely biased because the edges of the slit move apart forcefully during the hinge movement. Moreover, the frequency of the passages from the conventional position to the mule position and vice versa cause a rapid wear on the thread and an enlargement of the stitching holes. Thus, the slit rapidly undergoes a residual deformation which renders the shoe unaesthetic in either one of the positions, in addition to the unaesthetic aspect of the stitch itself.

Still other inventions, such as those described in the documents IT 198 948 and DE 196 11 797 include rear constructions of the upper which make it possible to compress this portion by bellow systems. However, these devices only permit the introduction of the foot into the shoe more easily through the rear. Use as a mule cannot be envisioned because the compression of the rear of the upper is only partial and does not extend down to the sole.

SUMMARY OF THE INVENTION

One of the objects of the present invention is to propose a shoe, especially for the practice of sports, which can optionally retain the rear of the foot, or leave the rear of the foot exposed, while providing comfort and good foot retention in both positions.

Another object of the invention is to propose an aesthetic shoe which does not incur an untimely wear on the rear of its upper, and which maintains a good reversibility from one position to the other.

To achieve these objects, the shoe has at least one band which connects a heel piece, located at the rear of the heel, to a quarter. This band runs from the top of the upper and extends down to the sole, and it has a greater flexibility with respect to the heel piece and the lateral piece. Thus, the bending of the rear of the upper is focused in the flexible band, and is achieved by elastic deformation of the constituent material of the band, without showing any structural discontinuity of the upper.

In a first embodiment, the band is made out of a stretchable material and contributes to the shoe closing means.

In a second embodiment, the shoe has conventional closing means on the instep girth, and the band has a difference in flexibility with respect to the heel piece and to the quarter.

These two embodiments can be described according to three variations in which the flexible band includes a more rigid insert. In the first variation, the reinforcement does not extend down to the sole. In the second variation, the reinforcement extends down to the sole and has a bending zone. In the third variation, the reinforcement is connected to the heel piece through a bending zone.

BRIEF DESCRIPTION OF DRAWINGS

The invention will be better understood and other advantages thereof will become apparent from the description, with reference to the annexed drawings which are an integral part thereof. The description illustrates, by way of nonlimiting limiting examples, certain preferred embodiments, in which:

FIG. 1 schematically shows a three-quarter rear perspective view of the shoe in the first embodiment, where the heel piece is in the foot retaining position;

FIG. 1B shows a detail of FIG. 1 in a side view of the rear portion of the shoe;

DETAILED DESCRIPTION OF THE INVENTION

Figure 2:
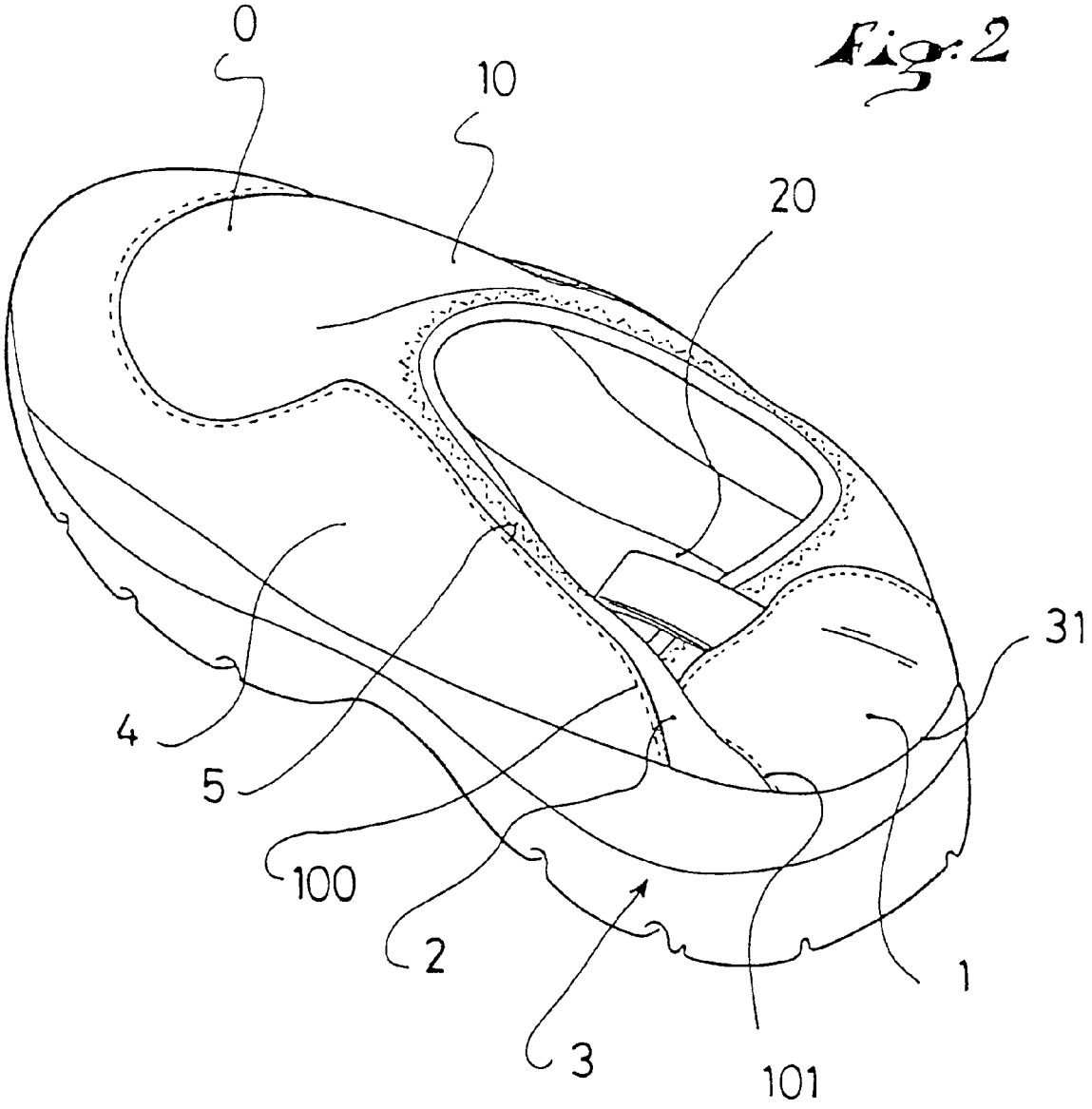
FIG. 2 schematically shows a three-quarter rear perspective view of the shoe of the first embodiment, where the heel piece is in the mule position.

FIG. 1 shows a shoe comprising an upper O mounted on a sole 3. The sole 3 includes an outer, or external, sole 3*b* overlaid by an intermediate sole 3*a*. In this embodiment, the upper O includes a liner 10 for enveloping the foot, on which a heel piece 1, provided with a loop 30, and a quarter 4, are externally fixed by appropriate assembling means such as stitches. The quarter 4 and the heel piece 1 are connected by a band 2 which is integral with the liner 10. Preferably, there are two bands 2 which are positioned substantially symmetrically on both sides of the heel piece 1.

In FIG. 1 the shoe does not have an opening on the instep girth. The introduction of the foot into the shoe is therefore performed by deformation of the liner 10, either in the area of the vamp 12 or in the area of the bands 2.

The bands 2 therefore play a double role; on the one hand, they participate in the introduction of the foot into the shoe in a known manner and, on the other hand, they make it possible to transform the shoe into a mule, as will be described later, with reference to FIG. 2. However, to fulfil their first function, the bands 2 are preferably made out of a stretchable material. Thus, the user moves the heel piece 1 toward the rear, by acting on the pull 30, with respect to the quarter 4. This movement is made possible by the longitudinal extension of the bands 2. For example, the bands 2 and, therefore, the liner 10, can be made of a polar material, an elastic material or Lycra®, and can be overlaid in their upper portion by an elastic finish 13 made of Lycra®, the upper finish 13 extending around the periphery of the foot opening. The heel piece 1 and the quarter 4 can be made of leather or a synthetic material.

FIG. 2 shows the same embodiment as that of FIG. 1, but the shoe is in the mule position in which the heel is free, no counter extending therearound. To obtain this position, the heel piece 1 is simply pushed into the shoe and put into contact with the inner sole 20. In order to make this position comfortable for the user, the heel piece 1, in the flattened position, must have a planar external surface for contact with the heel of the foot. To achieve this result, the bands 2 have a greater flexibility with respect to the heel piece 1 and with respect to the quarter 4, and the bands 2 extend to the sole 3. As can be seen in the drawing, the bands 2 have a lowermost extent approximate the rear end of the shoe, vertically beneath the rear end of the foot opening. The difference in flexibility between the bands 2 and both the heel piece 1 and quarter 4 makes it possible to ensure that the flexion zones, i.e., bending zones, of the upper, which are inherent in the mule position of the shoe, will remain localized in the bands 2.

This difference in flexibility can be obtained by two different procedures. Either the band 2 is made of a more flexible material than that of the heel piece 1 and that of the quarter 4, or the band 2 is thinner than the heel piece 1 and thinner than the quarter 4. Of course, these two procedures can be combined by retaining a band 2 whose material is more flexible than the quarter 4, and which is thinner than the heel piece 1, as well as the reverse combination. Thus, the bending is ensured by the elastic deformation of the material constituting the band 2; and the stitches 100, 101, which connect the band 2 to the quarter 4 and to the heel piece 1, respectively, are not biased. This arrangement ensures proper aging of the shoe and a good reversibility of the shoe between the two positions. In the preferred embodiment, these two procedures are associated by retaining a band 2 made of a material that is more flexible and thinner than the heel piece 1 and the quarter 4.

The fact that the bands 2 extend down to the sole allows the heel piece 1, which is connected to the sole 3 by an adhesive, to bend forwardly just in the area of its junction 31 with the intermediate sole 3*a*. Thus, the heel piece 1, which is flattened, is positioned in the extension of the inner sole 20 and renders the shoe more comfortable for use as a mule. To achieve this result, two procedures are envisioned: either the quarter 4 and the heel piece 1 are two separate parts, or the quarter 4 and the heel piece 1 form a single piece, as shown in FIG. 1B.

In FIG. 1B the quarter 4 and the heel piece 1 are connected by a junction 60 located beneath the band 2. This junction 60 has a height h that is reduced with respect to the remainder of the single constituent element of the quarter 4 and of the heel piece 1, so that the junction 60 does not extend above the sole 3. For example, the junction 60 can have a height h of 1 centimeter and is assembled on the sole 3 in a known manner, along with the remainder of the upper O, while ensuring that the junction 60 does not extend above the intermediate sole 3*a*.

As shown in FIG. 2, the shoe, in the mule position, takes a rear deformation that is guided by the shape of the quarter 4. The best results are obtained for the rear deformation if the rear cut 5 of the quarter 4, which is in contact with the band 2, has an approximate slope that decreases rearwardly and is comprised between a value of about 20–50 degrees. Similarly, the band 2 preferably runs into the sole 3 in the rear quarter length of the shoe. Respecting these constructive arrangements ensures a good compromise between comfort and lateral retention of the foot, when the shoe is in the mule position.

Figure 3:
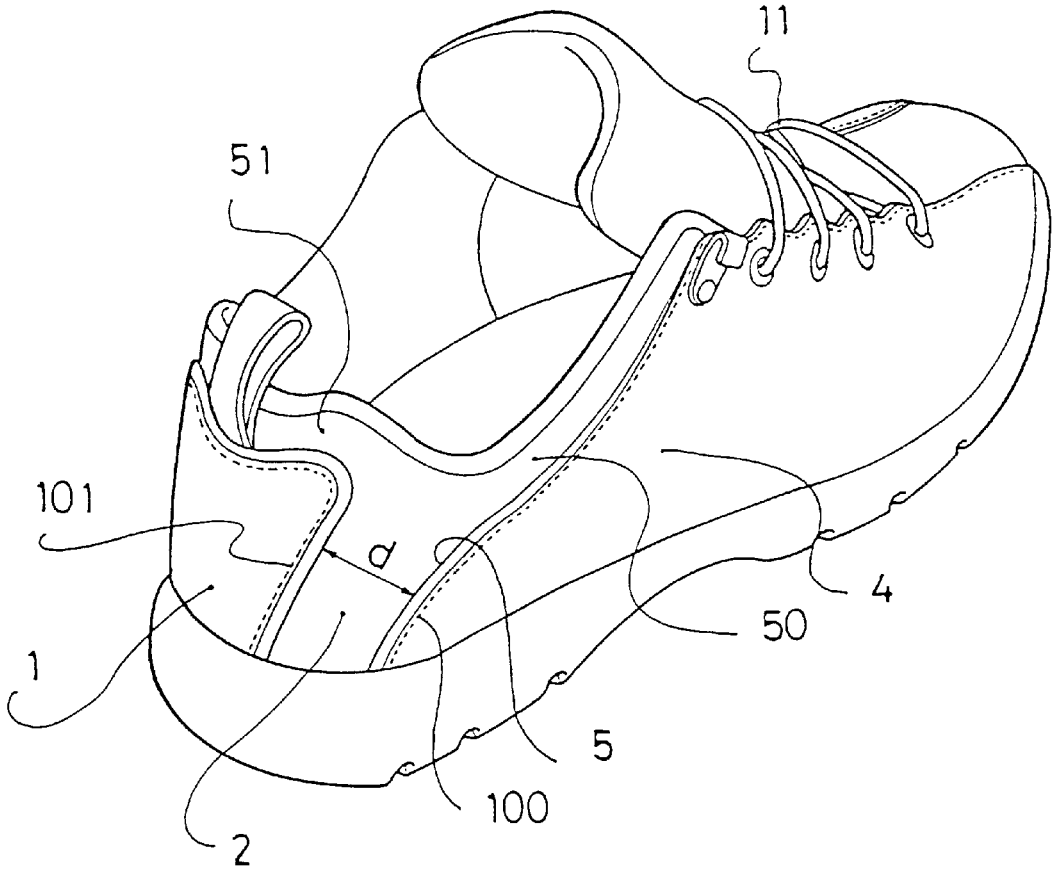
FIG. 3 schematically shows a three-quarter rear perspective view of the shoe in the second embodiment, where the heel piece is in the foot retaining position.

FIG. 3 shows a shoe having closing means 11, such as a lace, positioned on the quarter 4. FIG. 3 also shows the shoe to have a tongue beneath the lace. Thus, in contrast to the shoe of FIG. 1, the shoe of FIG. 3 has an opening extending downwardly and forwardly on the instep girth of the shoe for introducing the foot into the shoe. In this second embodiment, therefore, the bands 2 are independent of the function of introducing the foot into the shoe. Therefore, the band 2 is made of a material that is not stretchable but is simply more flexible than that of the heel piece 1 and that of the quarter 4. The various combinations of flexibility and thickness previously described remain valid for this embodiment. For example, the band 2 can be made of Nylon textile. Any other material can also be used. However, the material used for the band 2 is likely less flexible than the stretchable material used in the preceding embodiment. Therefore, it is necessary to provide a width d of the band 2 that is greater than that of the preceding embodiment. Thus, the band 2 will deform easily and does not bias the stitches 100, 101. The best results are obtained for a band 2 whose width d is comprised between about 1 and 5 centimeters. Similarly, with respect to comfort in the mule position, the best results are obtained if the band 2 extends up to the top of the upper O, and if the band 2 extends laterally as 50, 51, on the top of the upper, above the rear cut 5 of the quarter 4 and above the heel piece 1, respectively.

Figure 5:
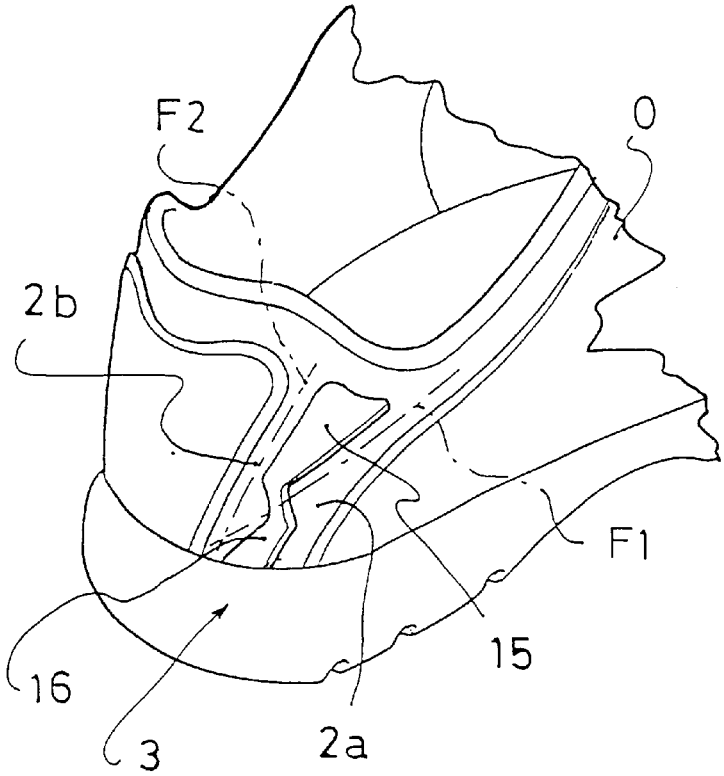
FIG. 5 schematically shows a three-quarter rear perspective view of the shoe in the second Variation of one of the two embodiments.
Figure 4:
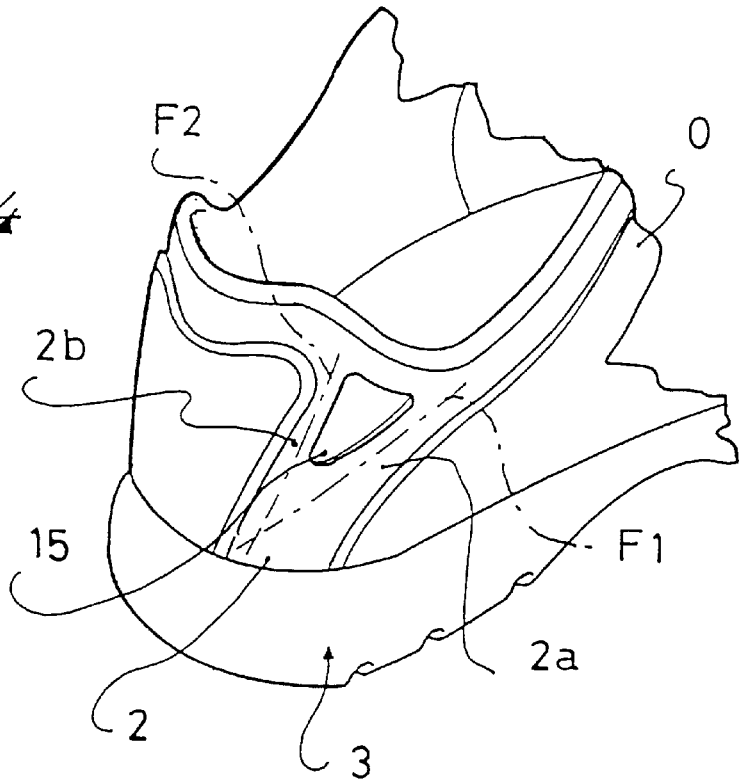
FIG. 4 schematically shows a three-quarter rear perspective view of the shoe in the first variation of one of the two embodiments.
Figure 6:
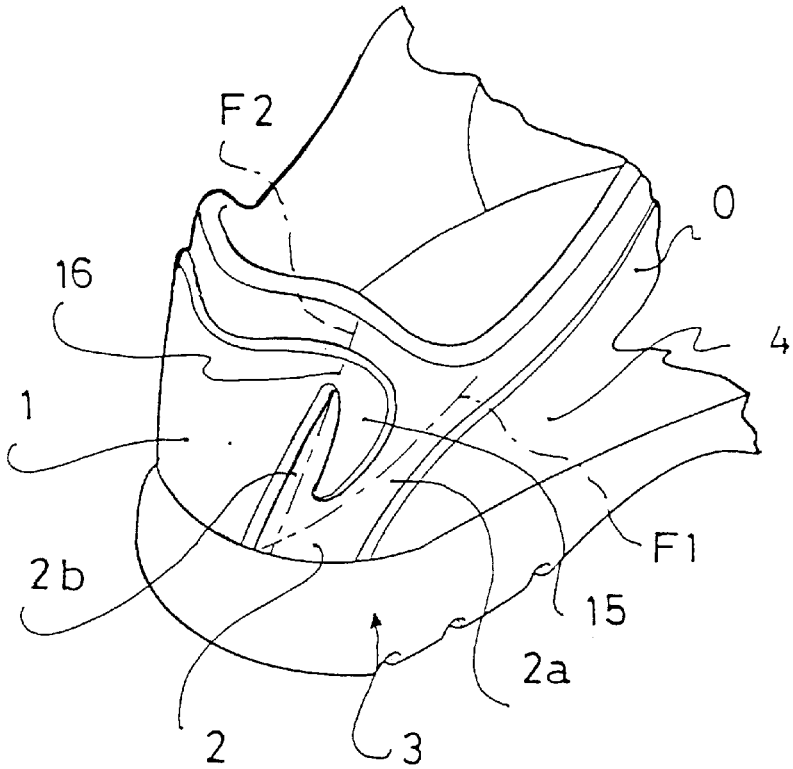
FIG. 6 schematically shows a three-quarter rear perspective view of the shoe in the third variation of one of the two embodiments.

FIGS. 4–7 show variations that are applicable to one of the two previously described embodiments. FIGS. 4–6 show the bending lines F1, F2 which are seen in the band 2 when the shoe is used in the mule position. The object of these variations is to propose embodiments which guide the bending of the band 2 along the bending lines F1, F2 and which reinforce the aestheticism of the shoe.

In FIG. 4 the band 2 is divided into two secondary bands 2*a*, 2*b* which are separated by an insert 15 that is more rigid than the band 2. The insert 15 is positioned on the top of the band 2 so as to leave the two preferred bending directions F1, F2 in the secondary bands 2*a*, 2*b*. For example, the insert 15 can be made of a material that is identical to that of the heel piece 1 or to that of the quarter 4, and is attached by stitching to the band 2. Because the secondary bands have a reduced width, it is preferred to adopt a band 2 made of a stretchable material. The insert 15 also makes it possible to have a better heel retention when the shoe is in the normal position.

FIGS. 5 and 6 use the descriptions and reference numerals of FIG. 4. In FIG. 5 the insert 15 extends down to the sole 3. Moreover, to facilitate the bending of the rear of the upper O along the flexion line F1, the insert 15 includes a bending zone 16. This bending zone 16 is positioned at the intersection of the flexion line F1 and the insert 15. The bending zone 16 has a width that is reduced along a direction substantially identical to the direction of the flexion line F1.

In FIG. 6 the insert 15 is an integral part of the heel piece 1, and it is connected to the latter through a bending zone 16. The bending zone is positioned at the level of the flexion line F2 and has a width reduced along a direction substantially identical to the direction of the flexion line F2. Other variations derived from that shown in FIG. 6 are also contemplated according to the invention. On the one hand, the insert 15 can be integral with the quarter 4 and have a bending zone in the area of the flexion line F1; on the other hand, the insert 15 and its bending zone 16 can be independent of the heel piece 1 and of the quarter 4, and can be attached to the band 2 by stitching.

Figure 7:
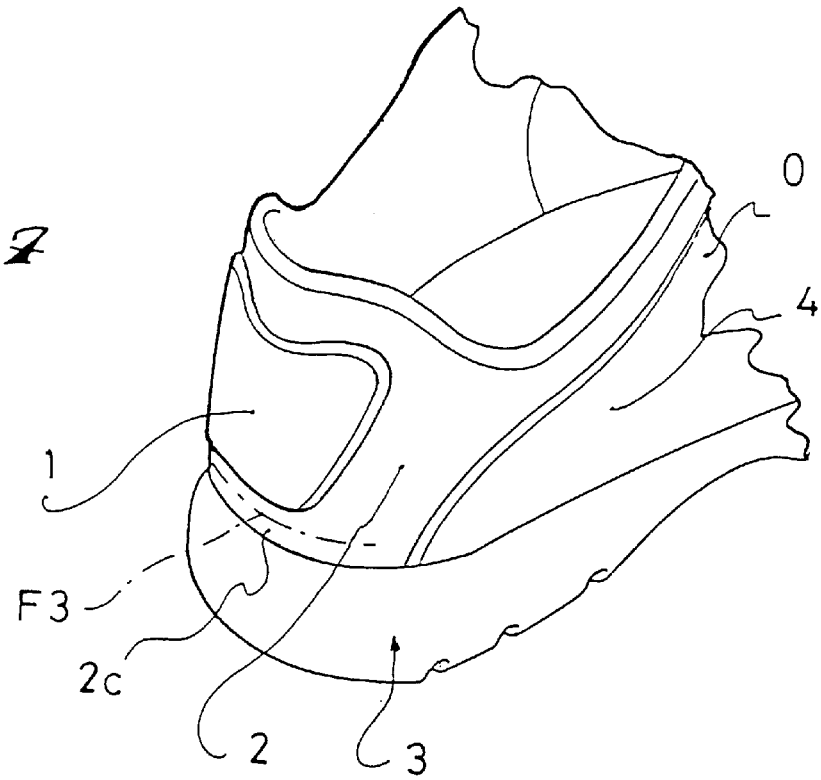
FIG. 7 schematically shows a three-quarter rear perspective view of the shoe in a fourth variation of one of the two embodiments.

FIG. 7 shows the flexion line F3 at the rear of the shoe, at the level of the sole 3, when the shoe is used in the mule position. To facilitate the recess of the heel piece 1 toward the interior of the shoe, the band 2 extends laterally beneath the heel piece 1, between the heel piece 1 and the sole 3. The extension of the band 2 thus constitutes a bending zone 2*c* that includes at least one portion of the flexion line F3. Because of the greater flexibility of the band 2 with respect to the heel piece 1, the bending zone 2*c* facilitates the bending seen along the flexion line F3. The bending zone 2*c* can advantageously connect the two bands 2 which are positioned substantially symmetrically relative to the shoe. The bending zone 2*c* thus completely separates the heel piece 1 from the sole 3, in order to facilitate the bending to the maximum. However, the heel piece 1 can be connected to the sole 3 through at least one bending zone that is integral with the heel piece 1. This bending zone makes it possible to laterally stabilize the heel piece 1 with respect to the rest of the shoe.

This variation can be combined with the other previously described variations and embodiments.

The invention is not limited to the particular embodiments described hereinabove, which are only given by way of illustration, but encompasses all similar or equivalent embodiments.

What is claimed is:

1. A shoe comprising:

an upper comprising at least one quarter and a heel piece; and a sole;

said upper comprising at least one non-stretchable band connecting said quarter to said heel piece, said band extending to said sole; and said band having a greater flexibility with respect to said heel piece and said quarter.

2. A shoe according to claim 1, wherein said band is made of more flexible material(s) than at least that of said heel piece or than that of said quarter.

3. A shoe according to claim 1, wherein said band is thinner than at least said heel piece or said quarter.

4. A shoe according to claim 1, wherein said band extends a top of said upper.

5. A shoe according to claim 1, comprising two bands, said two bands being positioned substantially symmetrically.

6. A shoe according to claim 5, wherein said bands are integral with a liner.

7. A shoe according to claim 6, wherein said heel piece and said quarter are fixed externally on the liner.

8. A shoe according to claim 1, wherein said band runs into said sole, in the rear quarter length of the shoe.

9. A shoe according to claim 1, wherein said band has a width is comprised between about 1 and 5 centimeters.

10. A shoe according to claim 1, wherein said band incorporates at least one insert that is more rigid than said band.

11. A shoe according to claim 10, wherein said insert extends to said sole.

12. A shoe according to claim 10, wherein said insert comprises at least one bending zone.

13. A shoe according to claim 1, wherein said band extends laterally beneath said heel piece, between the heel piece and said sole.

14. A shoe according to claim 1, wherein said band has a lowermost extent approximate a rear end of the shoe.

15. A shoe according to claim 1, wherein said upper includes a foot-entry opening and said band has a lowermost extent vertically beneath a rear end of said foot-entry opening.

16. A shoe according to claim 1, wherein said quarter has an upper edge in contact with said band, said upper edge extending rearwardly and downwardly toward said sole.

17. A shoe according to claim 1, wherein said upper comprises a liner integrated with said band, said liner defining a foot-entry opening.

18. A shoe comprising:

an upper comprising at least one quarter and a heel piece, the quarter having [has] a rear cut in contact with said band, and an approximate slope decreasing rearwardly comprising a value in a range of about 20–50 degrees; and a sole;

said upper comprising at least one band connecting said quarter to said heel piece, said band extending to said sole; and said band having a greater flexibility with respect to said heel piece and said quarter.

19. A shoe according to claim 18, wherein said band is made of a non-stretchable material.

20. A shoe according to claim 18, wherein said band has a lowermost extent approximate a rear end of the shoe.

21. A shoe according to claim 18, wherein said upper includes a foot-entry opening and said band has a lowermost extent vertically beneath a rear end of said foot-entry opening.

22. A shoe according to claim 18, wherein said upper comprises a liner integrated with said band, said liner defining a foot-entry opening.

23. A shoe comprising:

a sole;

an upper affixed above said sole, said upper comprising at least one quarter and a heel piece, said heel piece constituting a rearmost portion of said upper, said heel piece being spaced apart in an area of said upper at least along a portion of a vertical extent of said heel piece;

said upper further comprising a foot-entry opening extending forwardly and downwardly in an instep girth region of the shoe, a tongue positioned within said foot-entry opening, and a foot-tightening device positioned above said tongue;

said upper further comprising non-stretchable material in said area of said upper extending between said quarter and said heel piece, said material being more flexible than both said quarter and said heel piece;

said upper comprises a first upwardly extending flexion zone extending within said area of said upper between said quarter and said heel piece on a first lateral side of said heel piece, said upper further comprising a second upwardly extending flexion zone extending within a second area of said upper on a second lateral side of said heel piece.

24. A shoe according to claim 23, wherein:

said area of said upper between said quarter and said heel piece extends downwardly to said sole.

25. A shoe according to claim 23, wherein:

said first and second upwardly extending flexion zones space apart said quarter and said heel piece.

26. A shoe according to claim 23, wherein:

said quarter and said heel piece are made of leather.

27. A shoe according to claim 23, wherein:

said quarter and said heel piece are made of synthetic material.

28. A shoe according to claim 23, wherein:

said area of said upper between said quarter and said heel piece is thinner than both said quarter and said heel piece.

29. A shoe according to claim 23, wherein:

said upper comprises a liner to envelop a foot of a wearer;

said material in said area of said upper between said quarter and said heel piece are unitary with said liner;

said quarter and said heel are affixed onto said liner.

30. A shoe according to claim 23, wherein said foot-tightening device comprises a lace.

31. A shoe comprising:

an upper comprising at least one quarter and a heel piece; and a sole;

said upper comprising at least one non-elastic band connecting said quarter to said heel piece, said band extending to said sole; and said band having a greater flexibility than said heel piece and said quarter.

32. A shoe comprising:

an upper comprising at least one quarter and a heel piece; and a sole;

said upper comprising at least one non-stretchable band connecting said quarter to said heel piece, said band extending to said sole, said upper further comprising a foot-entry opening on an instep girth region of the shoe; and said band having a greater flexibility than said heel piece and said quarter.

33. A shoe according to claim 32, wherein said foot-entry opening on the instep girth extends downwardly and forwardly along a forward portion of the shoe.

34. A shoe according to claim 32, further comprising a closing means for said foot-entry opening.

35. A shoe according to claim 34, wherein said closing means comprises a lace.

* * * * *